US006702119B2

(12) United States Patent
Sabounjian

(10) Patent No.: US 6,702,119 B2
(45) Date of Patent: Mar. 9, 2004

(54) POPUP WARDROBE

(75) Inventor: Azad Sabounjian, Anaheim Hills, CA (US)

(73) Assignee: Pro-Mart Industries, Inc., Irvine, CA (US)

( * ) Notice: Subject to any disclaimer, the term of this patent is extended or adjusted under 35 U.S.C. 154(b) by 0 days.

(21) Appl. No.: 09/995,261

(22) Filed: Nov. 27, 2001

(65) Prior Publication Data

US 2003/0098250 A1 May 29, 2003

(51) Int. Cl.[7] ..... A45C 5/12; A45C 7/00; A47B 61/00; A47B 61/06

(52) U.S. Cl. ..... 206/577; 206/278; 206/298; 206/527; 190/13 R; 190/14; 190/107; 190/126; 312/6

(58) Field of Search ..... 206/279, 289, 206/577, 527; 135/120.1, 125, 126; 211/35.3, 123, 204; 383/104; 190/1.4, 13 R, 24, 107, 122, 126; 312/6; 220/4.28, 9.2

(56) References Cited

U.S. PATENT DOCUMENTS

| | | | | | |
|---|---|---|---|---|---|
| 356,301 | A | | 1/1887 | Belknap | 220/9.3 |
| 1,375,397 | A | * | 4/1921 | Lawrence | 220/9.2 X |
| 1,615,430 | A | * | 1/1927 | Woodruff | 190/14 X |
| 1,629,362 | A | * | 5/1927 | Robert | 190/13 R |
| 1,990,804 | A | | 2/1935 | Watson | 135/128 |
| 2,182,932 | A | | 12/1939 | Sanford | 220/9.3 |
| 2,215,695 | A | * | 9/1940 | Ginsberg | 190/113 X |
| 2,298,786 | A | * | 10/1942 | Dubofsky et al. | 190/126 |
| 2,476,932 | A | * | 7/1949 | Tucker | 190/24 X |
| 2,526,285 | A | * | 10/1950 | Schuyler | 211/204 X |
| 2,561,841 | A | * | 7/1951 | Cart | 206/287 |
| 2,562,444 | A | * | 7/1951 | Beer | 206/287 |
| 2,606,636 | A | * | 8/1952 | Braverman | 206/287 |
| 2,645,541 | A | * | 7/1953 | Mintz et al. | 206/287 |
| 2,710,084 | A | | 6/1955 | Braveman | 190/107 |
| 2,778,560 | A | | 1/1957 | Pfeiffer | 220/9.2 |
| 2,841,257 | A | * | 7/1958 | Dallas | 206/287 |
| 2,963,030 | A | * | 12/1960 | Blanchard | 135/120.1 X |
| 3,043,440 | A | * | 7/1962 | Berlin | 211/178 |

(List continued on next page.)

FOREIGN PATENT DOCUMENTS

| | | | | |
|---|---|---|---|---|
| EP | 0924142 | | 6/1999 | |
| FR | 439501 | * | 4/1912 | 190/24 |
| FR | 1278083 | | 12/1961 | |
| FR | 2542989 | * | 9/1984 | 190/122 |
| GB | 792564 | | 3/1958 | |
| GB | 947445 | | 1/1964 | |
| GB | 1058962 | | 2/1967 | |
| WO | PCT/US97/17179 | | 5/1998 | |

*Primary Examiner*—Sue A. Weaver
(74) *Attorney, Agent, or Firm*—Stetina Brunda Garred & Brucker

(57) ABSTRACT

A pop-up container, including four side panels, a top panel and a floor panel constructing a close structure. At least one of the side panel has a zipper that allows the pop-up container to be open sufficiently wide such that one can easily store or access clothes in the container. The walls of the container are made of flexible and foldable material. At least two opposite panels comprise foldable perimeters with tension-loop frames so that the pop-up container can be collapsed into a flat piece and received in a carrying bag. The pop-up container further comprises a hanger bar detachably connected to the container for hanging clothes. The hanger bar may be supported from the ground to provide additional support to the hanger bar and container to prevent from bowing or buckling of the container. A method is also provided in which an enclosure is formed by un-coiling a plurality of panels each having a tension-loop frame with the panels being joined together to form the enclosure. A hanger bar is placed in the enclosure and between two opposing sides of the container. The method furhter includes supporting the hanger bar on the surface by using at least one leg extending between the hanger bar and the surface.

44 Claims, 4 Drawing Sheets

U.S. PATENT DOCUMENTS 3,052,249 A * 9/1962 Seaman et al. ..... 135/120.1 X
3,944,219 A * 3/1976 LoPresti ..... 211/123
4,134,479 A * 1/1979 Crider, Jr. ..... 206/289
4,224,754 A 9/1980 Derryberry ..... 43/1
4,236,543 A 12/1980 Moss ..... 135/3
4,267,905 A * 5/1981 Stewart ..... 190/13 R
4,299,365 A 11/1981 Battle ..... 248/99
4,463,883 A * 8/1984 DeVore ..... 211/96 X
4,512,477 A * 4/1985 Densen ..... 206/577
4,815,784 A 3/1989 Zheng ..... 296/97.7
4,858,634 A 8/1989 McLeese ..... 135/104
4,895,230 A * 1/1990 King ..... 190/107
4,953,815 A 9/1990 Beymer et al. ..... 248/97
4,982,820 A * 1/1991 Scott ..... 190/13 R X
5,273,142 A * 12/1993 Weber ..... 190/107
5,301,705 A 4/1994 Zheng ..... 135/104
5,343,887 A * 9/1994 Danaher ..... 135/104
5,411,046 A 5/1995 Wan ..... 135/126
5,430,980 A * 7/1995 Ferrier ..... 52/63
5,592,961 A 1/1997 Chin ..... 135/125
5,617,962 A * 4/1997 Chen ..... 211/204 X
5,664,596 A 9/1997 Zheng ..... 135/126
5,676,168 A 10/1997 Price ..... 135/126
5,800,067 A 9/1998 Easter ..... 383/104
5,809,592 A 9/1998 McAllister ..... 5/99.1
5,964,533 A 10/1999 Ziglar ..... 383/36
5,971,188 A 10/1999 Kellogg et al. ..... 220/9.2
6,032,685 A 3/2000 Zheng ..... 135/125
6,059,912 A 5/2000 Kellogg et al. ..... 156/217
6,109,282 A 8/2000 Yoon ..... 135/126
6,138,701 A 10/2000 Zheng ..... 135/125
6,199,229 B1 3/2001 Wong ..... 5/417
6,220,265 B1 4/2001 Zheng ..... 135/125
6,269,922 B1 * 8/2001 Gosse ..... 190/107
6,302,127 B1 10/2001 Gayton ..... 135/124
6,311,709 B1 11/2001 Louie et al. ..... 135/125
6,325,086 B1 12/2001 Shinner et al. ..... 135/126

* cited by examiner

POPUP WARDROBE

FIELD OF THE INVENTION

This invention relates to collapsible containers.

The invention relates in general to a collapsible container with a bar from which objects are suspended within the container, and is especially useful as a wardrobe for hanging and storing clothes. More particularly, the invention relates to a pop-open wardrobe that can be collapsed into one flat piece to be received in a carrying bag.

BACKGROUND OF THE INVENTION.

Collapsible containers have previously had stiff sides to support the weight of the hanger-bar and clothes hung on the bar. But those stiff sides are heavy and difficult to collapse. There is thus a need for a lightweight, easily collapsible container to support objects hung within the container, and there is a particular need for a collapsible wardrobe.

Collapsible hampers have been developed that have spring-loop frames formed of tension-loop members that stretch fabric panels sight to form a container. While light-weight and collapsible, those collapsible containers are not configured to support a hanger-bar, and lack the strength to support hung clothing or other objects. There is thus a need for strengthened collapsible containers, and for wardrobes that are lightweight and collapsible.

SUMMARY OF THE INVENTION

A collapsible container is provided that uses the tension-loop frame to form a collapsible container with flexible sides. A support frame is coupled to the flexible sides to support the hanger-bar from which clothes can be hung within the container. The support frame and hanger-bar can also be formed of a series of short tubes with ends of the tubes configured to nest with adjacent ends of adjacent tubes. This provides a light-weight and collapsible container, while providing the strength to support clothing hung from a bar within the container.

one version of this container comprises a wardrobe having an enclosed space formed by one, and preferably formed by a plurality of panels forming a plurality of sides. Each of the panels is made of a flexible material, and each of the panels is foldable such that the pop-open wardrobe can be folded into a flat piece. At least one of the panels includes an opening to allow access to the insides of the container, and preferably the opening is formed by a zipper to allow the wardrobe to be opened.

In one embodiment, the pop-open wardrobe comprises four side panels, a top panel and an optional but preferred floor panel. The top edges of the side panels are adjacent to the top panel, and the bottom edges of the side panels are adjacent to the floor panel. At least two opposite side panels comprise foldable perimeters. Preferably, each side panel comprises a perimeter encircling a flexible foldable sheet. One of the side panels has a an opening that can be releasably sealed, as by a zipper, to allow the user to open the wardrobe as needed. Preferably, the side panel with the zipper has at least a portion of the panel being transparent or translucent. One can thus have a view of the contents inside of the wardrobe without opening it. A hanger-bar is held across two opposite side panels for hanging clothes. The hanger bar has two legs received in loops that are attached on the opposite side panels. Alternatively, the legs of the hanger bar may extend a distance sufficient to reach the floor of the wardrobe and support surface on which the wardrobe rests, or the leg can extend through the floor panel to directly contact the support surface. A base can be added to the legs to provide additional support of the wardrobe.

When the hanger bar has two legs extending through the floor panel, preferably, but optionally, two grommets are included in the floor panel with the hanger bar extending through the grommets in order to protect the floor panel from being damaged by the hanger bar and the weight of the clothes supported by the hanger bar.

In a very simple form, the container has a plurality of panels formed by tension loop members, with the panels being joined at adjacent edges to form an enclosure. A hanger bar supported within the enclosure. In a further embodiment, the hanger bar is connected at each end to one of the panels. In a still further embodiment, a support is interposed between the hanger bar and a surface on which the container rests during use of the container to transfer weight from the hanger bar to the surface. The support can include a leg located at each opposing end of the hanger bar. The support could also include a pair of legs located at each opposing end of the hanger bar and arranged in an "A" frame support. The support could extend through an opening in the container to contact the surface. Preferably, the hanger bar has legs at opposing ends of the hanger bar with the legs being connected to the flexible material. The distal end of the legs can connect to a base configured to stabilize the legs and hanger bar, or to do so in cooperation with the flexible frame and panels.

The container could have an opening that is releasably closed to allow access to the enclosure. In a further embodiment, one panel is completely open to allow ready access to the inside of the container. But preferably, one panel has a zippered opening therein, or an opening that may be held closed in other ways.

The base can comprise an elongated member with a T-shaped connection to fasten to the legs. The base can comprise an elongated member lying parallel to the plane of the surface which the container rests during use. The base can comprise a rectangular frame to which all legs fasten.

The improvements also include a kit for a collapsible container to be supported on a surface during use of the container. The kit includes the tension-loop frame, hanger bar and a collapsible support, preferably but optionally placed in a carry bag. The collapsible enclosure has at least one tension-loop frame with a flexible material on the frame to form a plurality of walls defining an enclosed space. An opening is preferably formed in one of the walls to allow access to the enclosed space, or one or more entire sides, top or end could be left completely open to allow access. The collapsible frame advantageously has a hanging bar with opposing ends removably connected to first and second legs. Each leg extends in planes generally parallel to each other and generally perpendicular to a longitudinal axis of the hanger bar. The legs extend a distance sufficient to support the hanger bar on the surface during use of the container. The legs are advantageously collapsible into shorter lengths for transportation and packaging.

In one embodiment, the legs comprise a plurality of elongated members that connect end-to-end to form two legs extending at an angle relative to each other to form an "A" shaped support on at least one end of the hanger bar. In another embodiment, a base connects to at least one of the legs, with the base being sized to stabilize the support of the hanger bar.

Preferably, the enclosure has a plurality of loops fastened to a wall of the enclosure adjacent at least one leg, with the loop sized and located so the at least one leg can extend through the loop when the container is assembled in order to couple the wall of the container to the at least one leg. Moreover, at least one of the walls can have a hole located and sized to allow a leg to extend through the hole during use of the container.

Also disclosed is a method of forming a collapsible container resting on a surface, with the container preferably, but optionally comprising a wardrobe. The method includes forming an enclosure container by un-coiling a at least one, and preferably a plurality of panels each having a tension-loop frame. The panel(s) form the enclosure. A hanger bar is placed in the enclosure and between two opposing sides of the container. The hanger bar is supported on the surface by using at least one leg extending between the hanger bar and the surface. Advantageously, the at least one leg is fastened to one of the panels. Moreover, the hanger bar is advantageously supported by a leg fastened to each of the opposing ends of the hanger bar. A base is advantageously fastened to a distal end of each leg. The legs can extend through holes in the enclosure, and the base can be placed outside the enclosure.

BRIEF DESCRIPTION OF THE DRAWINGS

Both the foregoing general description and the following detailed description are exemplary and explanatory only and are not restrictive of the invention, as claimed. The above and other advantages of this invention will be better understood and explained by reference to the following description and drawings in which like numbers refer to like parts throughout.

DETAILED DESCRIPTION

Figure 1:
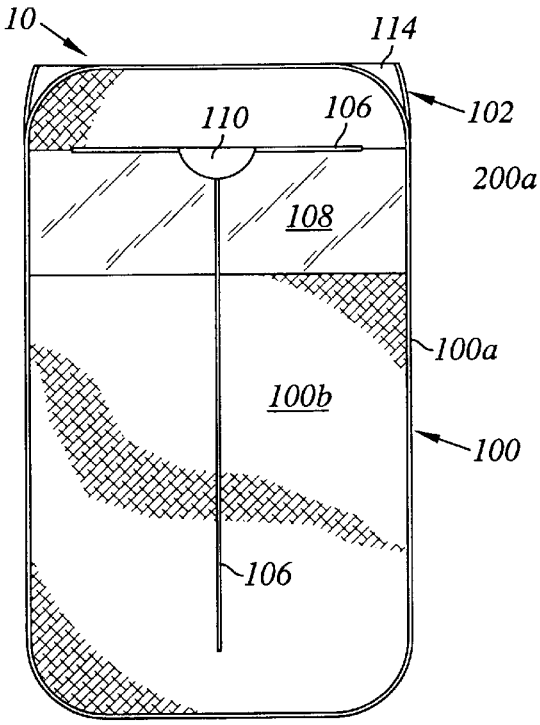
FIG. 1 shows a front view of a pop-up container provided by the invention, of which the front panel is zipped.
Figure 2:
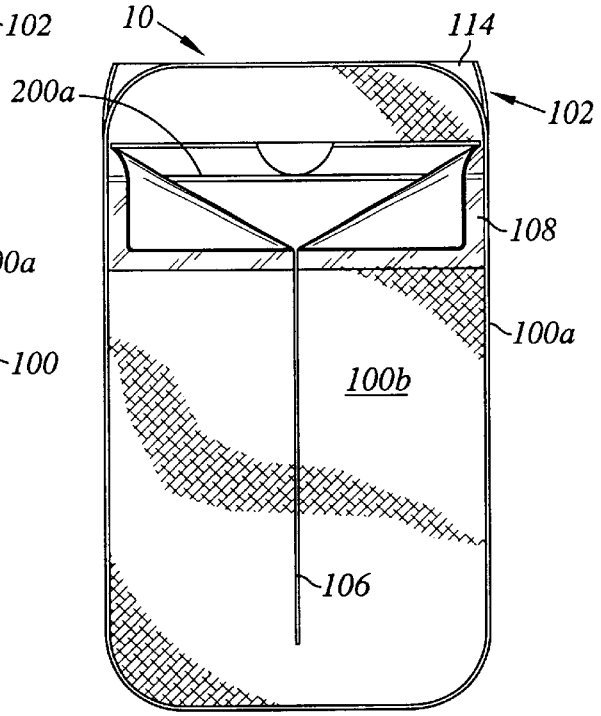
FIG. 2 shows the front view of the pop-up container with the zipper partly open.
Figure 3:
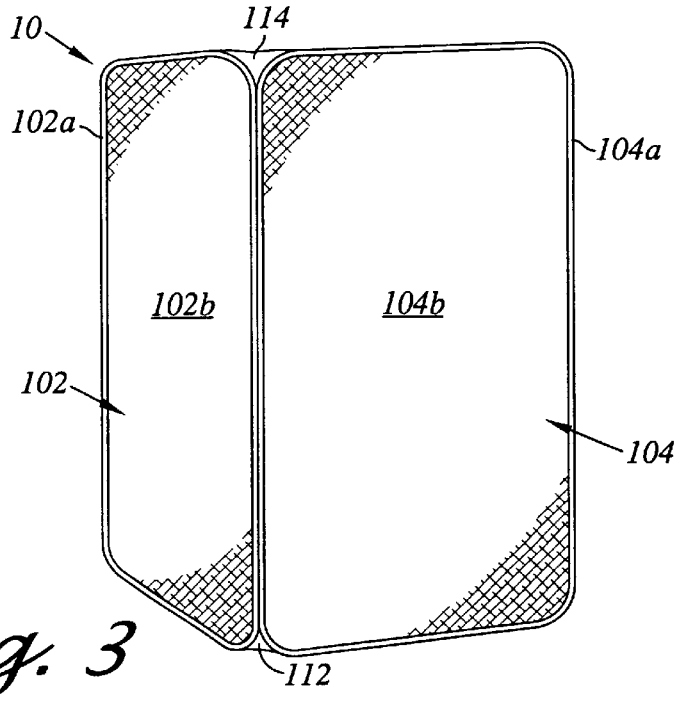
FIG. 3 shows a side view of the pop-up container.

Referring to FIGS. 1–3, a collapsible container 10 is disclosed that has special use as a pop-up wardrobe for clothes storage or for storage of other objects suspended from a bar or hanger bar within the container. The pop-up container 10 comprises a flexible enclosure having a front panel 100, two side panels 102, a rear panel 104, a floor panel 112 and a top panel 114. The front panel 100 and the rear panel 104 are opposite to each other, and preferably in generally parallel planes and of the same size, shape and other dimensions. The two side panels 102 located between the front and the rear panels are also opposite to each other, and again, preferably in generally parallel planes and of the same size, shape and other dimensions. The dimensions of the side, front panel and rear panel are large enough to enclose the items intended to be placed in the container 10, and preferably large enough so that various kinds of clothes or other objects can be accommodated or hung in the container.

Figure 17:
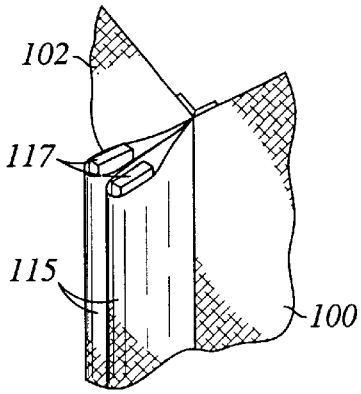
FIG. 17 shows a perspective view of the tension-loop frame.

Preferably, at least one pair of the panels, that is, the front and rear panels 100, 104, or the two opposing side panels 102, have foldable but sufficiently stiff perimeters such that the wardrobe can pop open from a collapsed to an expanded configuration with the tension of the perimeters causing the enclosure to remain in that expanded configuration. The tension-loop frames hold the flexible material of the panels taut. By appropriately joining two or more panels in a ring, a partial enclosure can be formed, and a top and bottom can be added to form a completely enclosed space. Advantageously all four vertical sided panels have such stiff perimeters. These stiff perimeters can be formed by placing pockets 115 around the perimeters with the pockets containing tension-loop frames 117 (FIG. 17). The pockets 115, or the panels formed by the frames 117 can be joined by means known in the art and not described in detail herein. The panels 100, 102, 104, 112, 114 and tension-loop enclosures of the type used herein are described in more detail in U.S. Pat. Nos. 5,964,533 and 5,816,279, the entire contents of which are incorporated herein by reference.

Preferably, each of the side panels 102 and the front and rear panels 100, 104, respectively have a perimeter formed by such tension-loop frames, with the frames joined along the generally vertical sides. Alternatively, it is possible, but less preferable, to have the top 114, front 100, bottom 112 and back 104 sides formed by panels having these tension-loop frames, with the abutting edges of those panels being joined. Moreover, it is also possible, but less preferable, to have the top 114, sides 102 and bottom 112 formed by these tension loop frames with abutting edges of those panels being joined.

FIG. 1 shows a front view of the pop-up container 10 having a front panel 100 with a perimeter or periphery 100*a*. Each edge of the perimeter 100*a* of the front panel is joined with a adjacent panel, or to the perimeter of another panel of the pop-up container 10. More specifically, a top edge of the front panel 100 is connected to the top panel 114, a bottom edge of the front panel 100 is connected to the floor panel 112 (FIG. 3), side edges of the front panel 100 are connected to two opposing side panels 102. A back or rear panel 104 is located opposite the front panel 100, with the side edges of the back panel also being joined to the edges of the side panels 102. As used herein, the directions up, down, or top, bottom refer to directions relative to the earth, with gravity being directed downward. These directions are given for ease of illustrating the invention, but the directions are relative and can change depending on the orientation of the container 10.

The front panel 100 comprises a foldable perimeter 100*a* and a flexible panel 100*b*. The flexible panel 100*b* preferably, but optionally, includes a viewing portion 108 that is sufficiently transparent or translucent to allow the user to see into the container 10 the contents stored the pop-up wardrobe sufficiently to identify the contents of the container 10. FIG. 1 shows the viewing portion 108 extending in a strip across a width of the front panel 100*b*, located at about the eye-level of a user of the container 10. The size, shape, location and number of the viewing portion(s) 108 can vary. Indeed, the entire container 10 can be made of transparent or translucent material if desired. Preferably, the panels forming the enclosure of the container 10 are made of nylon or other flexible fabric, but could be made of flexible plastic or polymer-based material.

Figure 14:
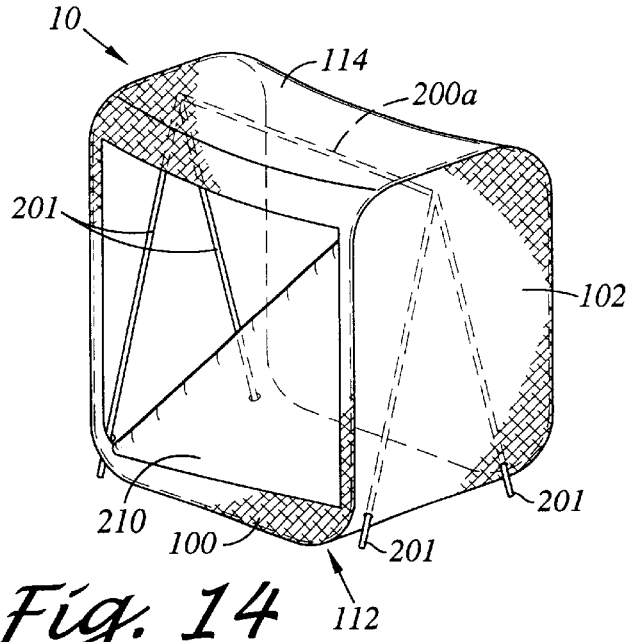
FIG. 14 shows further embodiment with a single tension-loop frame.

The front panel 100 has an opening or door 210 that is preferably, but optionally, releasably held closed by a releasable closure mechanism 106, as by a zipper zip-lock seal, string ties, snaps, twist locks, latches or other releasable closure mechanisms. The closure mechanism 106 preferably allows a T-shaped opening to be releasably formed, and can be achieved by a horizontal zipper and a vertical zipper forming a T-shape with the cross-bar of the T located at the upper end of the front panel. That orientation allows a user of the container 10 to open the pop-up container wide enough for an easy access to the contents in the container 10. The piece that interlocks or opens the zipper 106 can be covered with a lip 110, which extends from the flexible foldable panel 100*b* and is shown as located at the intersection of the horizontal and vertical parts forming the T-shaped opening. Other shaped openings can be used, as for example, an opening hinged or bending along the entire bottom and open on the sides and top to form an inverted "U" shape access door (FIG. 14).

As shown in FIG. 17, the foldable perimeter 100*a* preferably comprises a pocket 115 or series of loops extending around the periphery of the panel, with a foldable, flexible frame 117, such as spring tension loop placed in the pocket or extending through the loops and being restrained by the pocket or loops and the flexible material of the panels. The tension loop frame 117 can be made of spring steel or plastic. In one embodiment of the invention, such material is enclosed in a loop stitched along the perimeter 100*a* of the front panel 100. Preferably, four of the panels that form the container 10 have this tension-loop construction along the perimeter, although it is possible to have as few as two opposing panels with the tension-loop construction.

Figure 9:
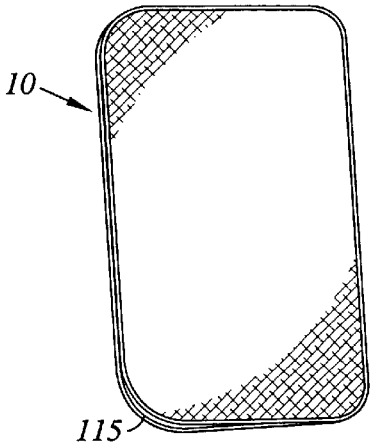
FIG. 9 shows the panels folded flat on top of each other.
Figure 10:
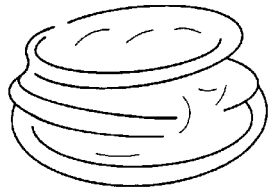
FIG. 10 shows the collapsed container.

When constructed in this manner, the container 10 can be collapsed by folding the panels 100, 102 and 104 on top of each other to form a stack of planar panels as shown in FIG. 9. The bottom 112 and top 114 can be folded between these overlapping panels 112, 114. Preferably, but optionally, the material on the panels and the tension-loop frame 117 are constructed to allow the stack to then be twisted into overlapping loops or coils of smaller diameter than the size of the panels. Three, overlapping coils are commonly achieved, as shown in FIG. 9. The coiled loops can be stored in a bag or other container, or held together by a strap, as shown in FIG. 10. The coiled loops tend to spring open because of the tension loop frame. When released from a collapsed, coiled configuration the container pops-open.

The above described and illustrated portion of the detailed description thus provides means for forming a collapsible enclosure of flexible material with a tension-loop frame, which enclosure has an opening that is preferably, but optionally releasably closeable, and which enclosure preferably but optionally has a viewing window.

FIG. 2 shows the front panel of the pop-up container 10 when the zipper 106 is partly open. As shown in FIG. 2, the pop-up container 10 further comprises an elongated member such as hanger bar 200 for hanging items, such as clothes, inside of the pop-up container 10. The hanger bar 200 is located at a position where the user of the container 10 can access or hang the objects or clothes inside of the container 10. The hanger bar 200 extends between opposing sides 102 of the container 10 and is preferably horizontal. The detailed structure of the rod is further described in the following paragraph.

Figure 4:
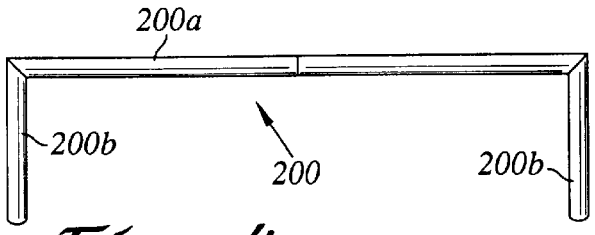
FIG. 4 shows the hanger bar used in the pop-up container for hanging objects.
Figure 13:
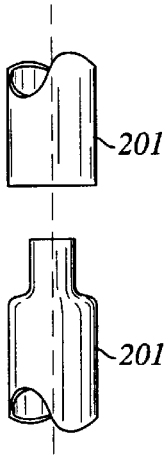
FIG. 13 shows a detail of a nested connection for the hanger bar of this invention.

FIG. 4 shows the hanger bar 200 detached from the container 10. The hanger bar 200 comprises a bar 200*a* sized to extend between two supports located adjacent the sides 102. Preferably the hanger bar 200 has two short legs 200*b* extending perpendicularly from opposing ends of the bar 200*a*. The hanger bar 200*a* is generally horizontal in use and the legs 200*b* are typically in a vertical plane. The hanger bar 200*a* can be of one piece, or multiple pieces removably fastened together using various removable joinder mechanisms, such as nested ends(as shown in FIG. 13 relative to legs 201).

Figure 5:
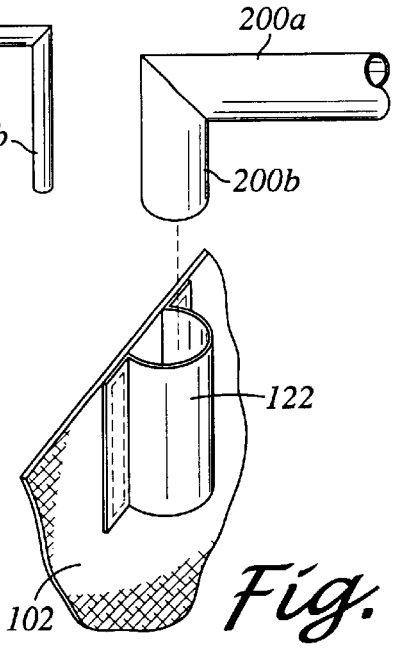
FIG. 5 shows a loop for holding the hanger bar as shown in FIG. 4.

In FIG. 5, a retaining means, such as pockets or loops 122 are formed on interior surfaces of the side panels 102. The retaining means 122 are configured to allow the hanger bar legs 200*b* to be firmly but releasably held inside of the pop-up container 10. Pockets 122 are sized and shaped to correspond to the legs 200*b* and can be formed by sewing, riveting, gluing or otherwise fastening strips of material to the panels such as panels 102. For example, when the legs 200*b* of the hanger bar 200 are 4.25 inches long, the pockets 122 are sized to enclose the distal end of legs 200*b* and engage the very end of the leg to help carry load placed on the hanger bar. Alternatively, loops 122 can be used which lack the closed end of the pocket. The pocket has the advantage of engaging the end of the leg 200*b* to transfer load in the plane of the panel 102 to which the pocket is fastened. But the loop has the advantage of allowing longer legs as discussed below.

Figure 6:
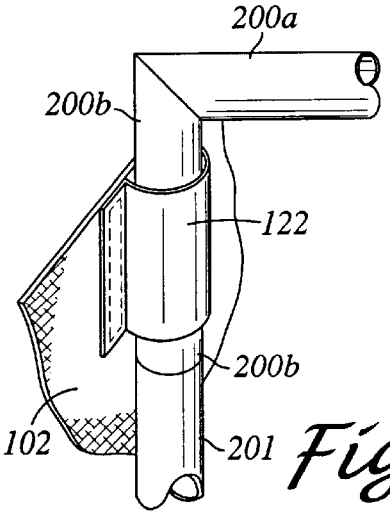
FIG. 6 shows the exterior of a panel with a connecting loop sewn to the panel.

FIG. 6 shows the exterior view of loops 122 sewn to the side panels 102. The vertically extending legs 200*b* can be made as an integral with the bar 200*a*, or alternatively, they can be detachable from the bar 200*a* as by nesting tubes as illustrated in FIG. 13, or threaded ends, or other removable connections. The removable connection between the hanger bar 200*a* and side panels 102 can take many forms is not to be limited by the disclosed embodiments. Other removable connections including a hook on each opposing end of the hanger bar 200*a* cooperating with a loop fastened to the sides 102, or hooks fastened to the sides 102 to releasable engage apertures or loops in the hanger bar 200*a* or on the ends of hanger bar 200*a*.

When the hanger bar 200 is fastened to the side panels 102 as discussed above, the side panels carry the entire weight of any objects hung from the hanger bar 200. The material from which the side panels or walls are formed is preferably selected to be strong as well as flexible. Canvas or heavy nylon is preferred, although other materials can be used.

If additional support is needed or desired to carry the weight on the hanger bar 200*a*, then a support can be interposed between the ground and the hanger bar 200*a*. If a support is used then the material forming the walls and panels need not be as strong as in the above embodiments. The support can comprise a single support or leg 201 extending between the hanger bar 200*a* and ground, located anywhere along the length of the hanger bar 200*a*. But preferably the support is provided by having a leg 201 on each end of the hanger bar 200*a* extend to the floor panel 112, which presumably rests on the ground or other support surface. Advantageously, the legs 201 removably connect to the hanger bar 200*a*, and preferably connect to one of the legs 200*b*. This is shown in FIGS. 5 and 6. Various junctures can be used to removably connect the legs 201 to the hanger bar, including the use of nested ends as shown in FIG. 13 (or T joints as seen in FIG. 14). The legs 201 are preferably tubular and of sufficient size to adequately support the weight to be placed on hanger bar 200*a*. The legs can be of a single piece, or of multiple lengths removably joined together as discussed above.

The legs 201 are preferably, but optionally coupled to the adjacent side panels 102 in various ways. Loops 122 fastened to the side panels are believed suitable to allow passage of the legs 201 while connecting the legs to the side adjacent panel in order to help maintain the orientation of the legs relative to the side panel. Any number of loops 122 or elongated strips may be formed, stitched, riveted, glued or otherwise fastened to the interior surface of the side panels 102 for holding the elongated legs 201. The loops 122 could be of hook-and-loop construction to allow the loops to be opened and closed. Snaps, ties and other releasable fasteners could also be used to provide releasable loops 122.

The hanger bar 200*a* and its support legs 201 thus provide a sturdy support frame for the objects to be suspended from hanger bar 200*a* and allows at least a portion of the weight of suspended objects to be transferred by the legs 201 rather than by the panels of the container 10. The loops 122 and panels 100, 102, 104 and the support frame 117 in the panels help maintain the orientation of the hanger bar 200*a* and legs 201, but the great bulk of the weight is preferably carried by legs 201 and hanger bar 200. But depending on the relative strength of the legs 201 and the panels 100, 102, 104, the panels may carry a portion of the weight of the objects suspended from the bar 200*a*. The legs 201 thus provide a means for supporting at least a portion of the weight of objects suspended from the hanger bar 200*a*, and preferably provide the primary load support means. Preferably, the hanger bar 200 and legs 201 support the weight on the hanger bar, while the panels 100, 102, 104 enclose the hanger bar.

The legs 201 may be formed in one piece, or for portability could be formed of several parts that can be removably connected together. Tubes with ends formed to nest with the ends of adjacent tubes can be used. Tubes with threaded ends can be sued. Any variety of collapsible, elongated members can be used as long as the legs 122 can allow the hanger bar 200*a* to support the weight of objects suspended from the hanger bar. This is also true for the above removable connections on the hanger bar 200 and with the hanger bar 200. It is believed desirable to have the legs 201 formed of tubular members having a length no greater than the diameter of the coil formed when the container 10 is collapsed by coiling the panels 100, 102, 104 into three overlapping coils. The legs 201 and hanger bar 200 are preferably made of metal, such as steel or aluminum, or may be made of suitably strong plastics.

Figure 7:
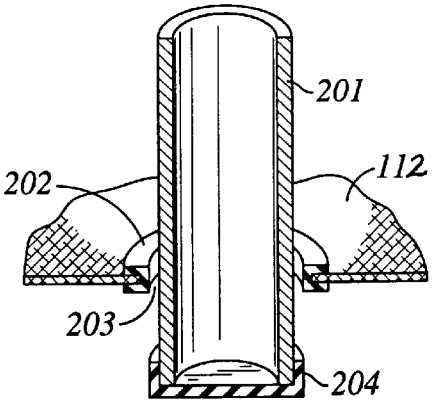
FIG. 7 shows the cross sectional view of a hole in the floor panel allowing a support leg to pass through the hole.

The distal ends of the legs 201 will wear through or cut through the bottom panel 112, especially when weight is carried by those legs. To avoid damaging the floor panel 112, holes or openings 203 may be formed in the floor panel 112 to allow the legs 201 to thread through the holes 203. Preferably, a grommet 202 is attached along the hole or opening 203 to provide a further protection as shown in FIG. 7. In addition, or alternatively, a cap, for example, a plastic cap 204 is preferably attached at the end of each leg 201 in order to help reduce the tendency of the ends of the legs 201 to cut the abutting surface.

Figure 12:
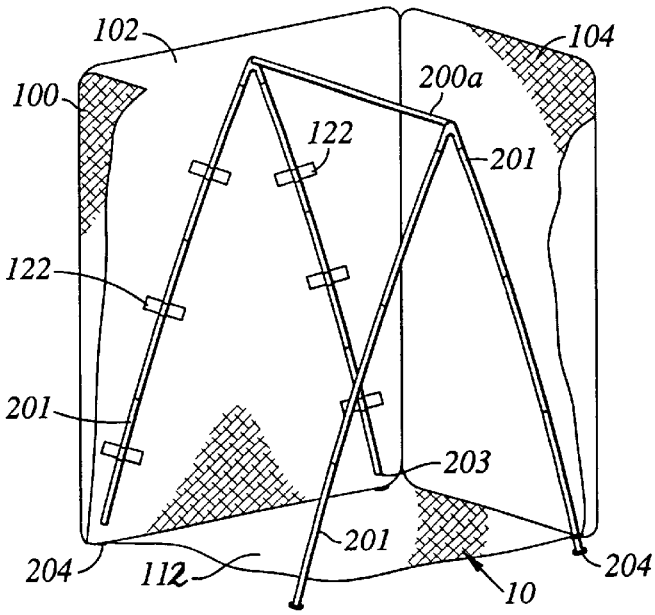
FIG. 12 shows a further embodiment with an "A" shaped support for the hanger bar.

The support is shown thus far as comprising generally vertical legs 201, with a single leg 201 on each of the opposing ends of the hanger bar 200*a*. The support for the hanger bar could take other forms. For example, FIG. 12 illustrates a further embodiment in which hanger bar 200*a* has two legs 201 on each of the opposing ends of the hanger bar 200*a*. In this embodiment the legs 200*b* extend at an angle form an "A" frame support for the hanger bar. The "A" shaped support can be formed of single-piece tubes. But the support could be formed of segmented legs that are removably connected as described above. An "A" connection can be used to connect the hanger bar 200*a* to the legs 201. The support is preferably, but optionally connected to the side panels 102 of the container 10 by loops 122. The A-frame support has the advantage of being self-supporting and not requiring the tension-loop frame (e.g., any of panels 100, 102, 104) of the container 10 to carry the weight of the load placed on the hanger bar 200*a* or to stabilize the A-frame. The support is still preferably connected to the panels 102 by loops 122 to the walls of the panels, but that connection is optional. Preferably there is one connection or loop 122 for each segment of the leg 201, but the number of connections can vary.

FIG. 14 shows a further embodiment of this invention in which a single tension-loop frame forms a generally rectangular enclosure having a plurality of walls. The hanger bar 200*a* is supported by a pair of legs 201 at each opposing end of the hanger bar, with the pair of legs forming an A-frame support. The legs 201 extend through holes 203 in the walls of the container 10 to rest against the surface on which the container 10 rests during use. No straps or loops 122 are shown in FIG. 13, but they could be used to couple the legs 201 to the walls of the container 10. A closable, flexible door 210 is formed in one wall of the container 10 to allow access to the enclosed space within the container 10. The previously described closure mechanisms, such as zippers, can be used to releasably connect the door to the container 10, and to open and close the door. In FIG. 13, the door has an inverted "U" shape and is shown with two of the three-sides of the "U" being unzipped or opened.

The length of the legs 201 is selected to accommodate the objects to be suspended from the hanger bar 200*a*. The legs 201 are preferably sized so that dresses, shirts, or both can be hung on the hanger bar 200*a* without having the clothing hit the bottom of the container 10.

Figure 8:
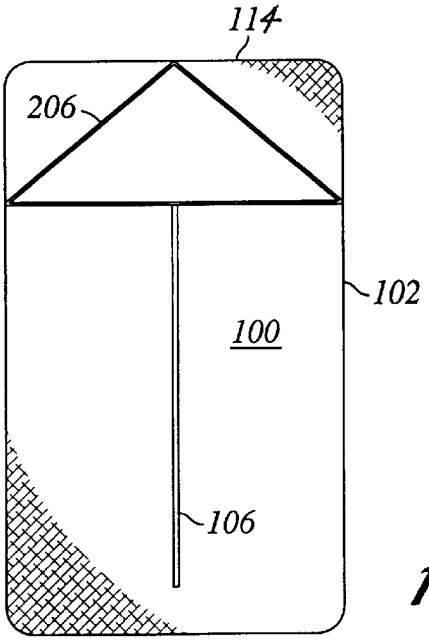
FIG. 8 shows a stiffening member to help prevent the container from unduly distorting when the zipper is open.

During use, the material forming the panels 100, 102, 104 carry some force as the tension-loop frames may bow and stretch the material forming the panels. To help resist bowing or significant distortion when the zipper 106 is open, a front panel strengthening member 206 is optionally, but preferably provided. The member 206 is preferably attached on an interior surface of the front panel 100 as shown in FIG. 8. The member 206 extends from a location adjacent to, and preferably at, the middle of the top side of the front panel 100, and extends to a location along the side adjacent to the location where the horizontal portion of the zipper 106 is located. The member 206 advantageously, but optionally comprises a flexible member, and preferably comprises a strip of material sewn or fastened to the panel 100 to strengthen the panel 100 by connecting the top and sides of the front panel. The member 206 can be of the same material as the panel 100, or it can be a stronger material such as a strip of flexible plastic or canvas. Two such members 206 are preferably provided, one for each of the opposing sides. Depending on the configuration of the opening in the front panel 100, the location and design of the members 206 can vary.

Figure 15:
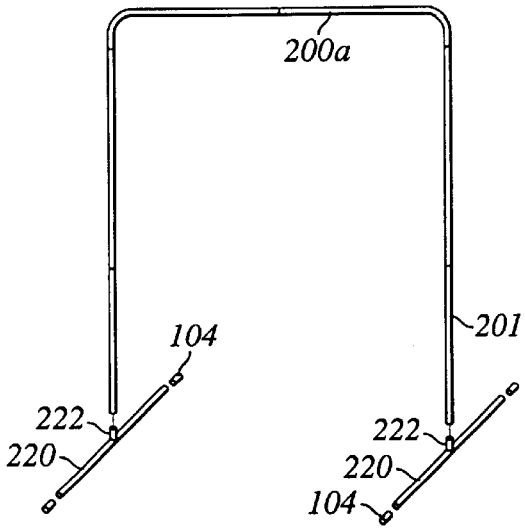
FIG. 15 shows a further embodiment with a "T" shaped base.
Figure 16:
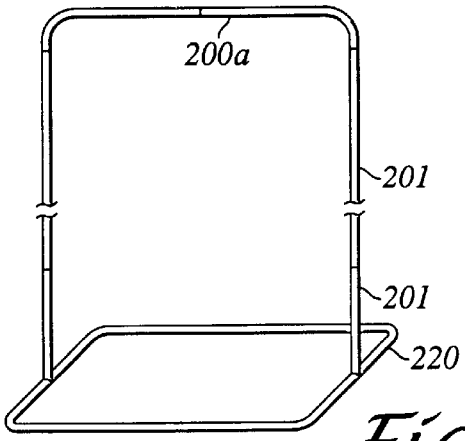
FIG. 16 s hows a further embodiment with a rectangular shaped base.

FIGS. 15–16 show a further embodiment that uses a base 220 lying against the ground or support surface to make the support frame formed by the hanger bar 200 and legs 201 a stable, self supporting structure. The base 220 is preferably, but optionally in a plane parallel to the support surface on which the container 10 rests during use of the container. The base 220 stabilizes the support of the hanger bar. The base 220 preferably is an elongated member such as a tube with a connection 222 to connect to the legs 201 supporting bar 200*a*. The base 220 is generally parallel to and rests on the ground. The base 220 is long enough to provide a stable hanger bar 201, and the amount of stability required will vary with the use of the container 10. If a tubular base 222 is used, caps 204 can be used to close off the ends and avoid sharp edges that may cut or damage the enclosing panels of the container 10. Preferably, but optionally, a T-connection 222 is used so the legs 201 can be removably inserted into the connection 222. A base 220 is preferably fastened to each leg 201. If the base 220 is used with the A-frame legs 201 shown in FIGS. 12 or 14, the connection 222 would be angled, and the length of the base could be shorter.

The base 220 could take other forms, such as a rectangular shape conforming to the shape of the adjacent floor panel 112 of the container 10, as shown in FIG. 15. The base 220 can be placed inside the container 10, or the legs 201 and/or connector 222 can extend through holes in the floor 112 and the base 220 can be placed outside the container 10. Fasteners 206 can be used to connect the legs 201 and/or hanger bar 200*a* to the adjacent panels forming container 10. The A-frame and base 220 provide self-supporting structures that preferably do not rely on the enclosure formed by tension loop panels forming the enclosure containing the hanger bar 200. The A-frame configuration and base 220 thus advantageously provided self-supporting means for supporting the hanger bar 200, and preferably provide independently stable, self-supporting means for supporting the hanger bar.

There is thus provided an enclosure 10 formed by at least one tension loop frame 117 means for at least one leg connected to the hanger bar and having a distal end supporting the hanger bar on the surface during use of the container.

There is also advantageously provided a collapsible container having an enclosure formed by a tension-loop frame. An opening is provided in the enclosure to allow access to the interior of the container 10. The opening is preferably formed in the front panel 100, but could be formed in other panels or portions of the container. Further, one wall of the container could be completely or partially open in order to provide access to the space enclosed by the remainder of the container. A support hanger bar 200*a* is placed inside the flexible walled enclosure where the enclosure is held in shape by a tension-loop frame. The support hanger bar 200*a* is preferably, but optionally fastened to the container 10. Preferably, but optionally, a support frame 201 is used to provided the majority, and preferably to provide a substantial majority (over about 75% and up to 100%) of the support for the hanger bar 200*a*. Advantageously, but optionally, the support frame 200*b* and/or leg 201 is coupled to the container, as by fasteners 206. There is thus provided an enclosure formed by a spring-loop frame enclosing a support frame preferably includes a hanging-rod 200*a* supported within the container. The legs 201 can be located entirely within the enclosure or they can extend through holes 203 in the enclosure forming the container 10. Preferably the legs 201 are enclosed within the container 10 and exit through holes 203 in the floor 112, although the holes 203 could be located in other panels, such as side panels 102.

The above embodiments have the support largely within the flexible enclosure formed by flexible, tension-loop frames 117. But the support comprising legs 201 could be predominantly located outside the enclosure, with the legs 201 unconnected to the enclosure or fastened to the flexible enclosure by loops 122 located on an exterior surface of one of the panels 100, 102, 104 forming the container 10. In this embodiment, the hanger bar 200 would extend through the panels forming the container, or the legs 201 would extend through the panels to fasten to the hanger bar.

The above embodiments describe the enclosure formed by the tension-loop frames 117 as completely enclosing a space, with at least one opening allowing access to the enclosed space. The opening could be so large that it comprises the entire panel 100, with no closable opening. This could be easily achieved by omitting the flexible material extending between the pockets 115 (FIG. 16) containing the frame 115. This would provide an open side panel 100. The open side panel need not be limited to the front side 100, but could comprise one or more of the panels 100, 102, 104. Similarly, the top and bottom panels 114, 112, respectively, could be omitted. Preferably though, the container 10 in completely enclosed and has one or more closable openings in one or more of the panels forming the enclosure.

Figure 11:
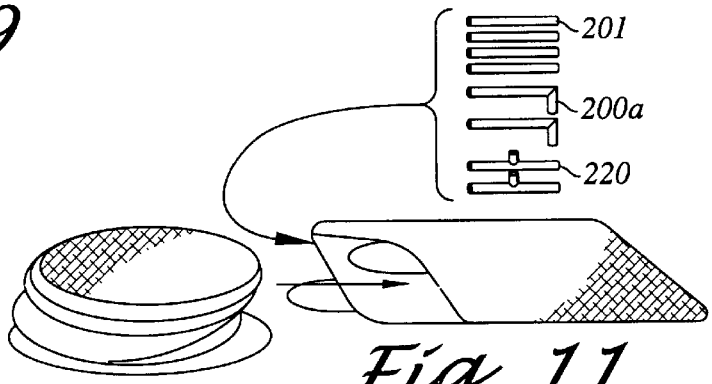
FIG. 11 shows that the container is collapsed and a carrying bag.

For shipment, the panels forming the container 10 are coiled and stored in a bag as shown in FIG. 11, along with the collapsible legs 201. Upon removal from the storage bag, the panels are expanded to form the flexible container 10. The hanger bar 200 is placed inside the container 10 and fastened to the walls of the container. Alternatively, hanger bar 200 can be supported inside the container by a support, such as legs 201. The legs are preferably assembled from segmented lengths to form a longer length sufficient to hold the hanger bar 200 at the desired height in the container 10. The legs 201 are advantageously extended through the walls forming the container 10 to support the hanger bar 200 directly on the support on which the container rests during use. A closeable opening is used to gain access to the hanger bar to suspend items from the bar.

The above description is given by way of example, and not limitation. Given the above disclosure, one skilled in the art could devise variations that are within the scope and spirit of the invention, including various ways of forming a support for the hanger-bar within the collapsible container. Further, the container is shown having four panels 100, 102, 104, but any number of panels can be used to form the container, including as few as a single tension frame, and more than four panels each with a tension frame. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

I claim:

1. A kit for a collapsible container to be supported on a surface during use of the container, the kit comprising:

a collapsible container having at least one tension-loop frame with a flexible material on the frame to form a plurality of walls defining an enclosed space, an opening being formed in one of the walls to allow access to the enclosed space;

a collapsible frame having a hanger bar with opposing ends; and first and second legs each of which is configured to connect to one of the opposing ends and extend therefrom in planes generally parallel to each other and generally perpendicular to a longitudinal axis of the hanger bar a distance sufficient to support the hanger bar on the surface during use of the container.

2. The kit of claim 1, wherein the legs comprises a plurality of elongated members that connect end-to-end to form a single, elongated member.

3. The kit of claim 1, wherein the legs comprise a plurality of elongated members that connect end-to-end to form two legs extending at an angle relative to each other to form an "A" shaped support on at least one end of the hanger bar.

4. The kit of claim 1, further comprising a base connected to at least one of the legs, the base being sized to stabilize the support of the hanger bar.

5. The kit of claim 1, wherein at least one of the walls has a hole located and sized to allow a leg to extend through the hole during use of the container.

6. A kit for a collapsible container to be supported on a surface during use of the container, the kit comprising:

a collapsible container having at least one tension-loop frame with a flexible material on the frame to form a plurality of walls defining an enclosed space, an opening being formed in one of the walls to allow access to the enclosed space;

a collapsible frame having a hanger bar with opposing ends; and first and second legs each of which is configured to connect to one of the opposing ends and extend therefrom in planes generally parallel to each other and generally perpendicular to a longitudinal axis of the hanger bar a distance sufficient to support the hanger bar on the surface during use of the container; and a plurality of loops fastened to a wall adjacent at least one leg, each loop being sized and located so the at least one leg can extend through the loop when the container is assembled in order to couple the wall of the container to the at least one leg.

7. The kit of claim 6, wherein the legs comprise a plurality of elongated members that connect end-to-end to form a single, elongated member.

8. The kit of claim 6, wherein the legs comprise a plurality of elongated members that connect end-to-end to form two legs extending at an angle relative to each other to form an "A" shaped support on at least one end of the hanger bar.

9. A collapsible container to be placed on a surface during use, comprising:

at least one tension-loop frame having at least one panel covered by flexible material and coupled to the frame by pockets on the panel that constrain the tension-loop frame, the frame and material defining an enclosed space, the material defining an opening allowing access to the enclosed space;

a hanger bar located in the enclosed space and supported by at least one of the panel and tension-loop frame or a support in contact with the hanger bar and with the surface on which the container rests during use.

10. The collapsible container of claim 9, wherein the hanger bar has legs at opposing ends of the hanger bar with the legs being connected to the flexible material by releasable connecting means.

11. The collapsible container of claim 9, wherein the hanger bar has legs at opposing ends of the hanger bar with the legs being connected to the flexible material by releasable connecting means, and wherein the legs extend to contact a surface on which the container rests in order to form the support and support the hanger bar on the surface during use of the container.

12. The collapsible container of claim 9, wherein the hanger bar has legs at opposing ends of the hanger bar which legs form part of the support, with the legs extending through holes in the flexible material a distance sufficient to contact a surface on which the container rests in order to support the hanger bar on the surface.

13. The collapsible container of claim 9, wherein the support comprises a pair of legs at each opposing end of the hanger bar with the two legs on each opposing end extending at angles to each other to form an "A" shaped support.

14. The collapsible container of claim 9, wherein the opening is formed by a flexible door formed in one panel.

15. The collapsible container of claim 14, further including a zipper releasably connecting the door to the panel.

16. The collapsible container of claim 9, wherein the support further comprises a leg at opposing ends of the hanger bar, the leg having a distal end connected to a base, the base supporting the container on the surface during use of the container.

17. A collapsible container, comprising:

an enclosure formed of flexible material held taut by at least one tension loop frame, the enclosure having an opening to allow access to an inside of the enclosure;

a hanger bar inside the enclosure, the hanger bar having opposing ends; and means for contacting a surface upon which a bottom of the enclosure rests during use for supporting the hanger bar inside the enclosure.

18. The collapsible container of claim 17, further comprising means for fastening a support to a side of the flexible enclosure.

19. A collapsible container which rests on a surface during use, comprising:

an enclosure formed of flexible material held taut by at least one tension loop frame, the enclosure having an opening to allow access to an inside of the enclosure;

a hanger bar inside the enclosure, the hanger bar having opposing first and second ends; and at least one leg connected to the hanger bar and having a distal end, the leg having sufficient length to support supporting the hanger bar on the surface during use of the container.

20. The collapsible container of claim 19, wherein the at least one leg comprises at least one leg connected to the first end of the hanger bar and at least one leg connected to the second end of the hanger bar.

21. The collapsible container of claim 20, wherein the leg extends through a hole in the container.

22. The collapsible container of claim 20, wherein the leg extends through a hole in the container and the distal end is connected to a base that is located outside the enclosure.

23. The collapsible container of claim 19, wherein the distal end is connected to a base that is large enough to stabilize the support of the hanger bar.

24. The collapsible container of claim 23, wherein the base comprises an elongated member lying parallel to the plane of the surface which the container rests during use.

25. The collapsible container of claim 23, wherein the leg is removably fastened to a side of the flexible enclosure by a member encircling the leg.

26. A collapsible container for resting on a support surface during use, comprising:

an enclosure formed of flexible material held by at least one tension loop frame, the enclosure having an opening to allow access to an inside of the enclosure, the container having flexible sides and a flexible bottom;

a hanger bar inside the enclosure, the hanger bar having opposing first and second ends; and a removable support frame at least partially enclosed in the enclosure and configured to be removably connected to the first and second ends, the support frame extending a distance sufficient to support the enclosure on the surface during use of the container.

27. The collapsible container of claim 26, further comprising a base connected to a distal end of the support frame to stabilize the hanger bar.

28. A container, comprising:

a plurality of panels formed by tension loop members, the panels joined at adjacent edges to form an enclosure having flexible sides and a flexible bottom;

a hanger bar supported within the enclosure; and a removable support interposed between the hanger bar and a surface on which the container rests during use of the container to transfer weight from the hanger bar to the surface.

29. The container of claim 28, wherein the hanger bar is connected at each end to one of the panels by releasable connecting means.

30. The container of claim 28, wherein the support comprises a leg located at each opposing end of the hanger bar.

31. The container of claim 28, wherein the support comprises a pair of legs located at each opposing end of the hanger bar.

32. The container of claim 28, wherein the support extends through an opening in the container to contact the surface.

33. The container of claim 28, wherein one panel has an opening that is releasably closed to allow access to the enclosure.

34. The container of claim 28, wherein one panel has a zippered opening therein.

35. The container of claim 28, further comprising a base connected to the support.

36. A collapsible container which rests on a surface during use, comprising:

an enclosure formed of flexible material held taut by at least one tension loop frame, the enclosure having an opening to allow access to an inside of the enclosure;

a hanger bar inside the enclosure, the hanger bar having opposing first and second ends; and at least one leg connected to the hanger bar and having a distal end, the leg having sufficient length to support supporting the hanger bar on the surface during use of the container, the distal end being connected to a base that is large enough to stabilize the support of the hanger bar, the base comprising an elongated member with a T-shaped connection.

37. A collapsible container which rests on a surface during use, comprising:

an enclosure formed of flexible material held taut by at least one tension loop frame, the enclosure having an opening to allow access to an inside of the enclosure;

a hanger bar inside the enclosure, the hanger bar having opposing first and second ends; and at least one first leg connected to the first end of the hanger bar and having a first distal end and having sufficient length to support the hanger bar on the surface during use of the container, and at least one second leg connected to the second end of the hanger bar and having a second distal end and having sufficient length to support the hanger bar on the surface during use of the container, and wherein the at least one first leg extends through a hole in the container and the first distal end is connected to a base that is located outside the enclosure, and wherein the at least one second leg extends through a hole in the container and the second distal end is connected to the base that is located outside the container.

38. A method of forming a wardrobe container resting on a surface, comprising:

forming an enclosure container by un-coiling a plurality of panels each having a tension-loop frame, the panels being joined together to form the enclosure, the enclosure having two opposing, flexible sides and a flexible bottom;

placing a hanger bar in the enclosure and between the two opposing sides of the container and supporting the hanger bar on the surface by using at least one leg extending between the hanger bar and the surface.

39. The method claim 38, further comprising fastening the at least one leg to one of the panels by releasable connecting means.

40. The method of claim 38, wherein the hanger bar has opposing ends and is supported by a leg fastened to each opposing end of the hanger bar.

41. The method of claim 40, further comprising fastening a base to a distal end of each leg.

42. The method of claim 40, further comprising extending the legs through holes in the enclosure.

43. The method of claim 41, further comprising extending the legs through holes in the enclosure and placing the base outside the enclosure.

44. A method of forming a wardrobe container resting on a surface, comprising:

forming an enclosure container by un-coiling a plurality of panels each having a tension-loop frame, the panels being joined together to form the enclosure;

placing a hanger bar in the enclosure and between two opposing sides of the container and supporting the hanger bar on the surface by using at least one leg extending between the hanger bar and the surface, the hanger bar having opposing ends and being supported by a leg fastened to each opposing end of the hanger bar;

fastening a base to a distal end of each leg; and extending the legs through holes in the enclosure and placing the base outside the enclosure.

* * * * *